US010734137B2

(12) United States Patent
Huang et al.

(10) Patent No.: US 10,734,137 B2
(45) Date of Patent: Aug. 4, 2020

(54) COMPOSITE CABLE

(71) Applicant: Hitachi Metals, Ltd., Tokyo (JP)

(72) Inventors: Detian Huang, Tokyo (JP); Yoshinori Tsukamoto, Tokyo (JP); Masanori Kobayashi, Tokyo (JP); Isao Matsuoka, Tokyo (JP); Masashi Moriyama, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/687,069

(22) Filed: Nov. 18, 2019

(65) Prior Publication Data

US 2020/0168367 A1 May 28, 2020

(30) Foreign Application Priority Data

Nov. 26, 2018 (JP) ..... 2018-220053

(51) Int. Cl.

| | |
|---|---|
| ***H01B 11/02*** | (2006.01) |
| ***H01B 11/18*** | (2006.01) |
| ***H01B 11/20*** | (2006.01) |
| ***H01B 11/04*** | (2006.01) |

(52) U.S. Cl.
CPC ..... *H01B 11/1891* (2013.01); *H01B 11/04* (2013.01); *H01B 11/1895* (2013.01); *H01B 11/20* (2013.01)

(58) Field of Classification Search
CPC ..... H01B 7/17; H01B 11/02; H01B 11/04
See application file for complete search history.

(56) References Cited

U.S. PATENT DOCUMENTS

| | | | | |
|---|---|---|---|---|
| 6,792,316 | B2 * | 9/2004 | Sass | A61N 1/05 600/373 |
| 9,390,842 | B2 * | 7/2016 | Hayashishita | H01B 13/34 |
| 2006/0210057 | A1 * | 9/2006 | Stanford | H04L 12/10 379/413 |
| 2012/0103646 | A1 * | 5/2012 | Fox | H01B 9/028 174/34 |
| 2012/0292079 | A1 * | 11/2012 | Muramatsu | H01B 11/20 174/113 R |

FOREIGN PATENT DOCUMENTS

| | | | |
|---|---|---|---|
| CN | 108831593 | * | 11/2018 |
| JP | 2000-123648 | A | 4/2000 |

* cited by examiner

*Primary Examiner* — Chau N Nguyen
(74) *Attorney, Agent, or Firm* — Thomas W. Cole; Roberts Calderon Safran & Cole, P.C.

(57) ABSTRACT

A composite cable is composed of a power supply wire, which includes a twisted wire pair aggregate, which are being formed by laying a plurality of twisted wire pairs together, a plurality of coaxial wires, and a plurality of signal wires, which are each smaller in outer diameter than the power supply wire and the plurality of coaxial wires. The plurality of coaxial wires and the plurality of signal wires are being laid helically over an outer periphery of the power supply wire, and each of the plurality of coaxial wires is being arranged in contact with an outer periphery of the power supply wire, and is being arranged at equally spaced intervals in a circumferential direction of the power supply wire, while each of the plurality of signal wires is being arranged in such a manner as to remain separate from the power supply wire.

8 Claims, 1 Drawing Sheet

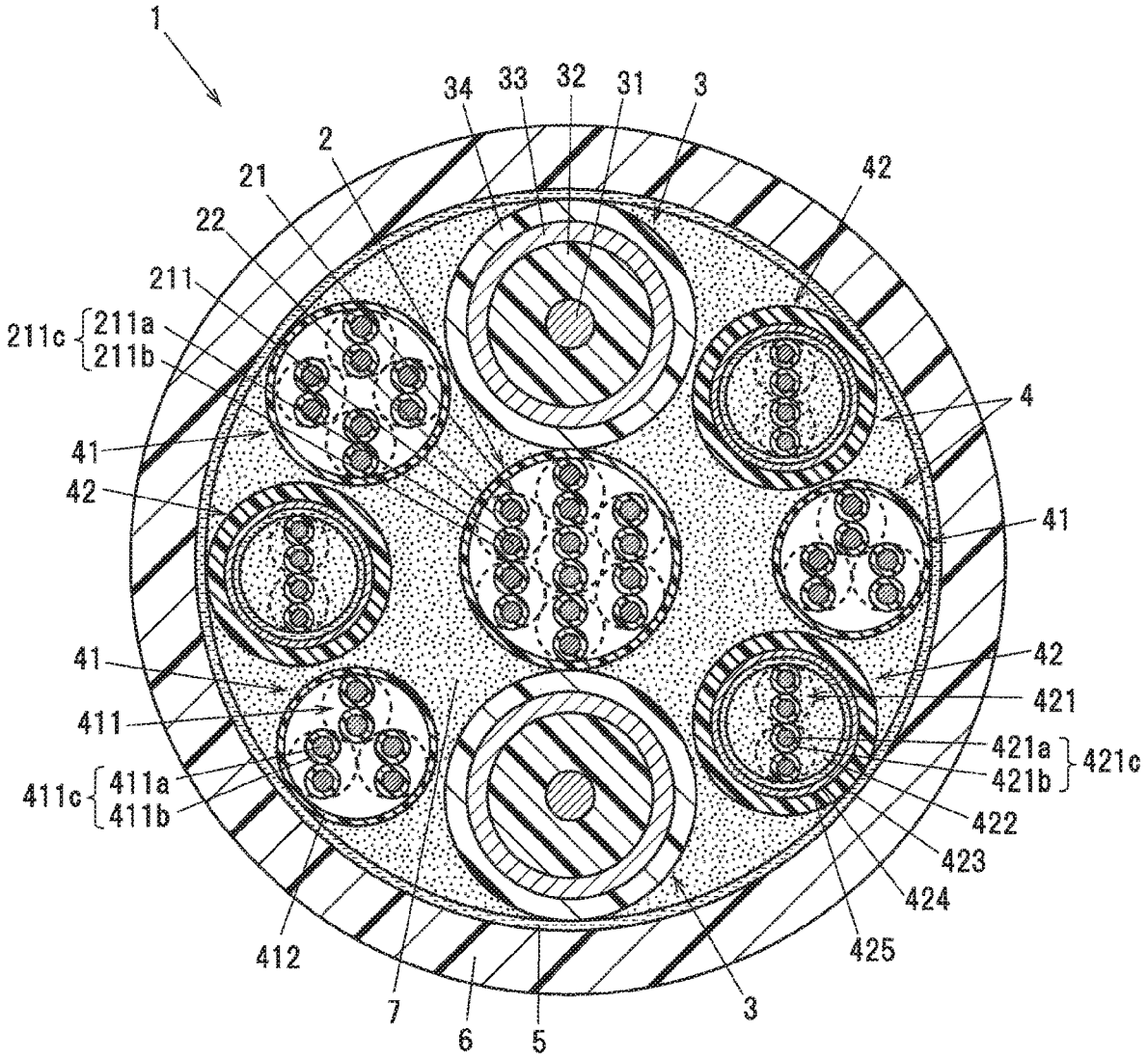
1
34
33
32
31
3
2
21
22
211
211c
211a
211b
42
4
41
42
41
41
411
411c
411a
411b
42
421
421a
421b
421c
422
423
424
425
412
7
6
5
3

COMPOSITE CABLE

CROSS-REFERENCE TO RELATED APPLICATION

The present invention is based on Japanese Patent Application No. 2018-220053 filed on Nov. 26, 2018, the entire contents of which are incorporated herein by reference.

BACKGROUND OF THE INVENTION

1. Field of the Invention

The present invention relates to a composite cable.

2. Description of the Related Art

As a composite cable to be used in indoor wiring, there is known a composite cable, which includes a coaxial wire and a signal wire being laid together therein, for example (see JP-A-2000-123648, for example).

[Patent Document 1] JP-A-2000-123648

SUMMARY OF THE INVENTION

In recent years, with increasing amount of information in communication between devices and with increasing communication speed therefor, the number of electric wires or cables of each type to be built into the composite cable is being increased, Which leads to an increase in outer diameter of the entire composite cable as well. However, a decrease in size of a connector to be connected to the devices is being desired, so minimizing the outer diameter of the composite cable to be connected to that connector is also being desired.

In addition, in the composite cable designed to use a communication wire designed for data communication and the like as its signal wire to carry out a high speed signal transmission, deterioration in transmission properties occurs due to a deformation of that signal wire caused by an externally applied stress in laying the electric wires or cables or in use (in bending, pressing and the like). In particular, when the composite cable is configured small in the outer diameter, the deformation of that signal wire may easily be caused by the externally applied stress.

Accordingly, it is an object of the present invention to provide a composite cable, which is small in diameter and resistant to the occurrence of deterioration in transmission properties due to an externally applied stress.

For the purpose of solving the above-described problems, the present invention provides a composite cable, comprising:

- a power supply wire including a twisted wire pair aggregate comprising a plurality of twisted wire pairs that are laid together;
- a plurality of coaxial wires; and
- a plurality of signal wires, each of which is smaller in outer diameter than the power supply wire and the plurality of coaxial wires,
- wherein the plurality of coaxial wires and the plurality of signal wires are being laid helically over an outer periphery of the power supply wire, and each of the plurality of coaxial wires is being arranged in contact with an outer periphery of the power supply wire, and is being arranged at substantially equally spaced intervals in a circumferential direction of the power supply wire,

- wherein each of the plurality of signal wires is arranged to separate from the power supply wire.

Points of the Invention

According to the present invention, it is possible to provide the composite cable, which is small in diameter and resistant to the occurrence of deterioration in transmission properties due to an externally applied stress.

BRIEF DESCRIPTION OF THE DRAWINGS

FIG. 1 is a cross-sectional view showing a cross section perpendicular to a longitudinal direction of a composite cable according to one embodiment of the present invention.

DETAILED DESCRIPTION OF THE PREFERRED EMBODIMENTS

Embodiment

An embodiment of the present invention will be described below in conjunction with the accompanying drawing.

FIG. 1 is a cross-sectional view showing a cross section perpendicular to a longitudinal direction of a composite cable according to the present embodiment. The composite cable 1 is being designed to be used as a wiring to monitor a motion condition of an industrial robot or a medical robot such as a robot arm and the like, with an image or a video, for example.

As shown in FIG. 1, the composite cable 1 is being configured to include a power wire 2, a plurality of coaxial wires 3, and a plurality of signal wires 4, which are each smaller in outer diameter than the power wire 2 and the plurality of coaxial wires 3. The power wire 2 is shown as one aspect of a power supply wire of the present invention. Further, the composite cable 1 has an outer diameter of on the order of e.g. 17 mm to 19 mm.

The power wire 2 is being configured to include a twisted wire pair aggregate 21, which is being formed by laying a plurality of twisted wire pairs 211 together, and a resin tape 22, which is being wrapped around an outer periphery of the twisted wire pair aggregate 21. Each of the twisted wire pairs 211 constituting the power wire 2 is being designed to be used for a low speed electric power supply signal transmission, such as a driving current supply to drive a motor (for example, an actuator and the like), and the like.

The twisted wire pairs 211 are each being formed by twisting together one pair of insulated electric wires 211*c* each being formed by coating an outer periphery of a respective stranded wire conductor 211*a* composed of laid wires (each wire has an outer diameter of e.g. 0.25 mm or less) made of an electrical conductor such as copper or the like, with a respective insulating material 211*b* made of a fluorine resin such as an ETFE (tetrafluoroethylene-ethylene copolymer), an FEP (tetrafluoroethylene-hexafluoropropylene copolymer), a PFA (tetrafluoroethylene-perfluoroalkylvinylether copolymer) or the like. Although herein the power wire 2 is shown as being formed by laying seven of the twisted wire pairs 211 together, the number of the twisted wire pairs 211 to be included in the power wire 2 is not limited to the above number. Further, the insulating materials 211*b* each have a thickness of e.g. 0.15 mm or less.

In the present embodiment, a lay direction of each of the stranded wire conductors 211*a* of the insulated electric wires 211*c* constituting the twisted wire pairs 211 and a lay direction of each of the twisted wire pairs 211 are being configured to be opposite directions to each other, while the lay direction of each of the twisted wire pairs 211 and a lay direction of the twisted wire pair aggregate 21 are being configured to be opposite directions to each other. The lay direction of each of the stranded wire conductors 211*a* of the insulated electric wires 211*c* constituting the twisted wire pairs 211 and the lay direction of the twisted wire pair aggregate 21 are being configured to be the same. This is because, if the lay direction of each of the twisted wire pairs 211 is the same as the lay direction of each of the stranded wire conductors 211*a* of the insulated electric wires 211*c* constituting the twisted wire pairs 211 and the lay direction of the twisted wire pair aggregate 21, the strands constituting the stranded wire conductors 211*a* are repeatedly twisted in the same direction, which may lead to strand necking and fracture during bending and the like. By configuring the lay direction of each of the twisted wire pairs 211 in the opposite direction to the lay direction of each of the stranded wire conductors 211*a* of the insulated electric wires 211*c* constituting the twisted wire pairs 211 and the lay direction of the twisted wire pair aggregate 21, it is possible to suppress the occurrence of a wire break in the strands and enhance the resistance to bending.

Note that the lay direction of the stranded wire conductor 211*a* is defined as the direction in which the constituent strands of the stranded wire conductor 211*a*, when observed from one end side of the insulated electric wire 211*c*, are turning from the other end side of the insulated electric wire 211*c* to that one end side. The lay direction of the twisted wire pair 211 is defined as the direction in which its constituent insulated electric wires 211*c*, when observed from one end side of the twisted wire pair 211, are turning from the other end side of the twisted wire pair 211 to that one end side. Further, the lay direction of the twisted wire pair aggregate 21 is defined as the direction in which their constituent twisted wire pairs 211, when observed from one end side of the twisted wire pair aggregate 21, are turning from the other end side of the twisted wire pair aggregate 21 to that one end side.

The resin tape 22 acts both to keep the twisted wire pair aggregate 21 bundled so that the twisted wire pair aggregate 21 is not unlaid, and to allow the power wire 2 when bent to be highly slidable between the power wire 2 and the plurality of coaxial wires 3, and between the power wire 2 and its constituent twisted wire pairs 211 in contact with the inner surface of the resin tape 22, to thereby suppress the occurrence of an abrasion due to being subjected to repealed bendings. As the resin tape 22, an abrasion resistant and highly slidable material may be used, and a tape which is made of a nylon, or a fluorine resin such as a PTFE (polytetrafluoroethylene), an ETFE (tetrafluoroethylene-ethylene copolymer) or the like can be used, for example.

The twisted wire pair aggregate 21 is being configured in such a manner that their constituent plurality of twisted wire pairs 211 bundled together in the resin tape 22 can be moved relatively freely relative to each other within the resin tape 22. Further, each of the plurality of twisted wire pairs 211 constituting the twisted wire pair aggregate 21 is being configured in such a manner that the twisted wire pairs 211 have their respective twist pitch lengths (lay lengths) different from each other, in order to suppress the occurrence of a crosstalk (a noise) between the twisted wire pairs 211. Note that the twist pitch length (lay length) of the twisted wire pair 211 refers to the distance between adjacent points in a longitudinal direction of that twisted wire pair 211 where each of its constituent insulated electric wires 211*c* lies at the same positions in a circumferential direction of that twisted wire pair 211.

The coaxial wires 3 are each being designed for an image or video signal transmission, and being designed to carry out a 100 MHz or higher frequency signal transmission, for example. The coaxial wires 3 are each being configured to include a respective stranded wire conductor 31 composed of laid wires (each wire has an outer diameter of e.g. 0.2 mm or less) made of an electrical conductor such as copper or the like, a respective insulating material 32, which is coating an outer periphery of the respective stranded wire conductor 31, a respective shield layer 33, which is coating an outer periphery of the respective insulating material 32, and a respective sheath 34, which is coating an outer periphery of the respective shield layer 33, Although the number of the coaxial wires 3 being used herein is described as being two, the number of the coaxial wires 3 is not limited to this. The respective shield layers 33 of the coaxial wires 3 are made of a braided shield composed of braided metal wires. As the respective constituent insulating materials 32 of the coaxial wires 3, it is possible to use a material made of a resin such as a cross-linked polyethylene or the like, for example. Further, as the shield layers 33, it is possible to use one or more layers of the braided shields composed of a plurality of wires (each wire has an outer diameter of e.g. 0.15 mm or less), Further, as the respective sheaths 34 of the coaxial wires 3, it is possible to use a sheath made of a polyvinyl chloride (PVC) resin or the like, for example.

The signal wires 4 are being configured to include three control signal wires 41, which are each being designed for a control signal transmission, and three communication wires (LAN cables) 42, which are each being designed for data communication. Although herein are described the three control signal wires 41 and the three communication wires 42 being included as the signal wires 4, the number of the control signal wires 41 and the number of the communication wires 42 are not limited to the above numbers. The control signal wires 41 and the communication wires 42 have a characteristic impedance of e.g. 75Ω or 100Ω.

The control signal wires 41 are each being designed for a control signal transmission to be used in control of various devices, such as control of an air injector, for example, to at least carry out a higher speed signal transmission than the power wire 2. The control signal wires 41 are each being formed by laying a respective plurality of twisted wire pairs 411 together, and wrapping a respective resin tape 412 around an outer periphery of the respective plurality of twisted wire pairs 411.

The respective plurality of twisted wire pairs 411 of each of the control signal wires 41 are each being formed by twisting together one pair of insulated electric wires 41*k* each having an insulating material 411*b* made of a fluorine resin such as an ETFE (tetrafluoroethylene-ethylene copolymer), an PEP (tetrafluoroethylene-hexafluoropropylene copolymer), a PFA (tetrafluoroethylene-perfluoroalkylvinylether copolymer) or the like around a periphery of a respective stranded wire conductor 411*a* composed of laid wires (for example, wires each having an outer diameter of 0.25 mm or less) made of an electrical conductor such as copper or the like. Note that, for the purpose of diameter reduction, it is preferable to configure each of the constituent insulating materials 411*b* of the insulated electric wires 411*c* to have a thickness of e.g. 0.15 turn or less. As the respective constituent resin tapes 412 of the control signal wires 41, as with the case of the resin tape 22 of the power wire 2 described above, it is possible to use a resin tape made of a nylon or a fluorine resin such as a PTFE (polytetrafluoroethylene), an ETFE (tetrafluoroethylene-ethylene copolymer) or the like, for example.

Although herein is shown the example using two of the three control signal wires 41 using three of the twisted wire pairs 411 and one of the three control signal wires 41 using four of the twisted wire pairs 411, the number of the twisted wire pairs 411 to be included in each of the control signal wires 41 is not limited to the above numbers. For the purpose of suppressing the occurrence of a crosstalk (a noise), the plurality of twisted wire pairs 411 to be included in each of the control signal wires 41 are configured to have their respective twist pitch lengths (lay lengths) different from each other.

The communication wires 42 are each being designed for a digital signal transmission to be used in a data communication, and being configured as a category Se to category 7 LAN cable, for example. The communication wires 42 are used to carry out a high frequency signal transmission of e.g. 1 MHz or higher and not higher than 600 MHz. The communication wires 42 are each being formed by laying respective two twisted wire pairs 421 designed as communication wires and a respective thread-like filling member 422 such as a staple fiber yarn or the like together, and in turn providing a respective binder tape 423, a respective shield layer 424, and a respective sheath 425 over an outer periphery of the respective two twisted wire pairs 421 and the respective thread-like filling member 422 being laid together.

The respective two twisted wire pairs 421 of the communication wires 42 are each being formed by twisting together one pair of insulated electric wires 42*k* each having a respective insulating material 421*b* made of a foamed resin such as a foamed propylene or the like around a periphery of a respective stranded wire conductor 421*a* composed of laid wires (each wire has an outer diameter of e.g. 0.2 mm or less) made of an electrical conductor such as copper or the like. By using the resin made of a foamed propylene as the foamed resin constituting the insulating materials 421*b*, it is possible to lower the relative permittivity of the insulating materials 421*b* with the thicknesses of the insulating materials 421*b* being reduced (to e.g. 0.2 mm or less), and thereby enhance the transmission properties at high frequencies. When the foamed resin is used as the insulating materials 421*b*, the transmission properties are easily deteriorated by a deformation due to an external force, but in the present embodiment, since the communication wires 42 are being configured in such a manner as to resist being subjected to the stress in bending (described in detail later), it is possible to use the foamed resin in the insulating materials 421*b*. Further, it is possible to use the crosslinked foamed resin in the insulating materials 421*b*.

The control signal wires 41 and the communication wires 42 being configured as the signal wires 4 are being configured to be smaller in outer diameter than the power wire 2 and the coaxial wires 3. More specifically, the outer diameters of the control signal wires 41 and the communication wires 42 being configured as the signal wires 4 are not more than 75% of the outer diameters of the coaxial wires 3. This makes it possible to allow the power wire 2 and the plurality of signal wires 4 to remain sufficiently separate from each other to further reduce the stress in bending to be exerted on the signal wires 4.

Further, in the present embodiment, the outer diameters of the control signal wires 41 and the communication wires 42 are being adjusted to be substantially the same. Specifically, the outer diameters of the control signal wires 41 are being set at not less than 80% and not more than 120% of the outer diameters of the communication wires 42. By configuring the outer diameters of the control signal wires 41 and the communication wires 42 to be substantially the same, the signal wires 4 have such even outer diameters as to be able to suppress the occurrence of a direction in which the signal wires 4 are difficult to bend, or the occurrence of an uneven laying in laying the signal wires 4. For example, the outer diameters of the control signal wires 41 and the communication wires 42 can be adjusted by adjusting the coating thicknesses of the constituent insulating materials 411*b* of the control signal wires 41, the coating thicknesses of the constituent sheaths 425 of the communication wires 42, and the like.

Now, typically, in a cable wired in a movable part, since the stress in bending is concentrated in a member located in a center of that cable, it is often the case that no electric wire is located in the central portion of that cable. In this case, however, the space in the central portion of the cable becomes wasted, and the cable becomes large (e.g. 20 mm or more) in outer diameter.

Accordingly, in the present embodiment, the cable is being structured in such a manner that, instead of locating no electric wire in the central portion of the cable, the power wire 2 is being located in the central portion of the cable 1, while the plurality of coaxial wires 3 and the plurality of signal wires 4 are being laid helically over an outer periphery of the power wire 2. Further, each of the coaxial wires 3 is being arranged in contact with the outer periphery of the power wire 2 and is being arranged at equally spaced intervals in a circumferential direction of the power wire 2, while each of the signal wires 4 is being arranged in such a manner as to remain separate from the power wire 2. It is preferable to allow each of the signal wires 4 to remain separate from the power wire 2 in such a manner that the centers of the signal wires 4 are located on a concentric circle having a radius defined as a distance from the center of the cable 1 (the center of the power wire 2) to the centers of the coaxial wires 3, or in an outer side of that concentric circle.

Since the power wire 2 is being designed for a low speed signal (power supply signal) transmission such as a motor driving current transmission and the like, the transmission properties are substantially unaffected even by being subjected to the stress. Furthermore, since the power wire 2 is using its constituent twisted wire pairs 211, the power wire 2 is highly resistant to bending. Furthermore, since the power wire 2 is being configured to allow its constituent twisted wire pairs 211 to be moved relatively freely relative to each other within the constituent resin tape 22 of that power wire 2, its constituent twisted wire pairs 211 when subjected to the stress in bending are moved into the spaces lying between those twisted wire pairs 211 and the resin tape 22 or between those twisted wire pairs 211 to thereby be able to release that stress.

In addition to the foregoing, by employing such a structure as to bring the plurality of coaxial wires 3 into contact with the power wire 2 but not bring the plurality of signal wires 4 into contact with the power wire 2, it is possible to allow the stress in bending to be exerted on the plurality of coaxial wires 3 configured larger in diameter, and be released to the power wire 2, so the plurality of signal wires 4 become resistant to being subjected to the stress in bending. As a result, it is possible to suppress the occurrence of a deformation in the cross-sectional shapes of the signal wires 4 during bending, and it is therefore possible to suppress the occurrence of deterioration in the transmission properties of the signal wires 4 designed to carry out a relatively high speed signal transmission.

The plurality of coaxial wires 3 configured larger in diameter are being arranged at equally spaced intervals in the circumferential direction of the composite cable 1. Note that the arrangement of the plurality of coaxial wires 3 may be made at not strictly equally spaced intervals, but such substantially equally spaced intervals that an error of on the order of ±10° is acceptable, in the circumferential direction of the composite cable 1. Further, it is desirable that the same numbers of signal wires 4 are evenly being arranged between adjacent coaxial wires 3, respectively, of the plurality of coaxial wires 3 being arranged at equally spaced intervals in the circumferential direction of the composite cable 1. This makes it possible to arrange the plurality of coaxial wires 3 and the plurality of signal wires 4 in a balanced manner (at rotationally symmetrical locations with respect to the center of the cable 1) over the outer periphery of the power wire 2, and thereby suppress the occurrence of a direction in which the coaxial wires 3 and the signal wires 4 are difficult to bend, or the occurrence of an uneven laying in laying the coaxial wires 3 and the signal wires 4 together. Note that, in the event of an uneven laying in laying the coaxial wires 3 and the signal wires 4 together, when the composite cable 1 is cut to a predetermined length, a difference between the lengths of the signal wires 4 or the coaxial wires 3 included in that composite cable 1 occurs, which may lead to a failure such as a lag in signal receiving timing and the like. By arranging the plurality of coaxial wires 3 and the plurality of signal wires 4 in a balanced manner over the outer periphery of the power wire 2, it is possible to suppress the occurrence of such a failure that the stress is concentrated in some of the electric wires during bending of the composite cable 1, and it is therefore possible to suppress the occurrence of a failure such as a wire break and the like due to being subjected to repeated bendings, and thereby make the composite cable 1 long life.

In addition, if the plurality of coaxial wires 3 are being arranged unevenly in the circumferential direction of the composite cable 1, the plurality of signal wires 4 are located intensively in a part in the circumferential direction of the composite cable 1, and when the composite cable 1 is subjected to a bending in a specific direction or the like, a stress may be concentrated in the plurality of signal wires 4, leading to deterioration in the transmission properties of the plurality of signal wires 4. By arranging the plurality of coaxial wires 3 at substantially equally spaced intervals in the circumferential direction of the composite cable 1 as in the present embodiment, it is possible to make the composite cable 1 resistant to being subjected to the stress concentration in the plurality of signal wires 4 caused by a bending or the like, and thereby suppress the occurrence of deterioration in the transmission properties due to the externally applied stress.

Further, in order to prevent the power wire 2 and the plurality of signal wires 4 from being brought into direct contact with each other, a filling member 7 may be provided between the power wire 2 and the plurality of signal wires 4. As the filling member 7, it is possible to use a thread-like member such as a staple fiber yarn or the like, for example. The staple fiber yarn is suitable for the filling member 7 of the composite cable 1 to be used for the movable part because that staple fiber yarn has such a proper cushioning performance that no fracture occurs even by bending. Note that the thread-like member to be used as the filling member 7 is not limited to that staple fiber yarn, but that it is possible to use the thread-like member made of a string, a paper, a non-woven fabric cloth, or the like, for example, as the filling member 7. Further, the filling member 7 is not limited to the thread-like member, but, for example, a strip-like member can be used as the filling member 7. The filling member 7 also acts to allow the cross-sectional shape of the composite cable 1 to return to a circular shape. It is preferable that the filling member 7 is being provided in such a manner as to impregnate spaces lying between the power wire 2, the plurality of coaxial wires 3, the plurality of signal wires 4, and a binder tape 5, which is being provided over an outer periphery of the power wire 2, the plurality of coaxial wires 3, and the plurality of signal wires 4.

The binder tape 5 is being swapped helically around an outer periphery of the plurality of coaxial wires 3 and the plurality of signal wires 4. A paper tape, a tape made of a non-woven fabric cloth, or the like can be used as the binder tape 5. A jacket 6, which is made of an insulating material, is being provided over an outer periphery of the binder tape 5. As the jacket 6, it is possible to use the jacket made of a polyvinyl chloride (PVC) resin, a polyurethane (PU) resin or the like, for example, so as to protect the composite cable 1 from an external force. Note that a shield layer, such as a braided shield or the like, may be provided on the outer periphery of the binder tape 5.

All the electric wires being arranged over the outer periphery of the power wire 2, each of the plurality of coaxial wires 3 and each of the plurality of signal wires 4 are being configured in such a manner as to remain in contact with an inner peripheral surface of the binder tape 5. The binder tape 5 is being wrapped by appropriately adjusting the amount and arrangement of the filling member 7, so that the binder tape 5 is substantially circular in a cross sectional view.

Note that the coaxial wires 3 and the signal wires 4 adjacent to each other or the signal wires 4 adjacent to each other in the circumferential direction of the composite cable 1 may remain in direct contact with each other, or may remain in no direct contact with each other by interposing the filling member 7 between those adjacent wires 3 and 4 and between those adjacent wires 4. It should be noted, however, that when the coaxial wires 3 and the signal wires 4 adjacent to each other or the signal wires 4 adjacent to each other in the circumferential direction of the composite cable 1 are in direct contact with each other, it is desirable to adjust an applied tensile force in laying the coaxial wires 3 and the signal wires 4, or an applied tensile force in wrapping the binder tape 5, so that those signal wires 4 are acted on by a minimized pressing force.

Operations and Advantageous Effects of the Embodiment

As described above, the composite cable 1 according to the present embodiment is being configured to include the power wire 2 including the twisted wire pair aggregate 21 being formed by laying the plurality of twisted wire pairs 211 together, the plurality of coaxial wires 3, and the plurality of signal wires 4 each having a smaller outer diameter than those of the power wire 2 and the plurality of coaxial wires 3, wherein the plurality of coaxial wires 3 and the plurality of signal wires 4 are being laid helically over the outer periphery of the power wire 2, and each of the plurality of coaxial wires 3 is being arranged in contact with the outer periphery of the power wire 2 and is being arranged at substantially equally spaced intervals in the circumferential direction of the power wire 2, while each of the plurality of signal wires 4 is being arranged in such a manner as to remain separate from the power wire 2.

In the composite cable 1, since the power wire 2 is being located in the center of the cable 1 to effectively utilize the wasted space lying in the center of the cable 1, it is possible to configure the entire composite cable 1 small in diameter. Although the stresses in bending, pressing and the like become concentrated in the power wire 2 being located in the center of the cable 1, since the power wire 2 is using its constituent twisted wire pair aggregate 21 being formed in such a manner that the plurality of twisted wire pairs 211 resistant to bending are further laid together, the power wire 2 becomes highly resistant to the externally applied stresses such as the bending stress and the like. In addition, since the power wire 2 is being designed for a low speed power supply signal transmission, even when the power wire 2 is being deformed by the stresses in bending, pressing and the like, the influence of that deformation on the transmission properties of the power wire 2 is inherently negligible.

In addition, by employing such a structure as to bring the plurality of coaxial wires 3 into contact with the power wire 2 but not bring the plurality of signal wires 4 into contact with the power wire 2, it is possible to configure the composite cable 1 in such a manner as to allow the stresses in bending and the like to be exerted on the plurality of coaxial wires 3 configured larger in diameter, and be released to the power wire 2 side, and it is therefore possible to suppress the stresses in bending and the like from being exerted on the plurality of signal wires 4. As a result, it is possible to suppress the occurrence of a deformation in the cross-sectional shapes of the signal wires 4 during bending and the like, and it is therefore possible to suppress the occurrence of deterioration in the transmission properties of the signal wires 4 designed to carry out a relatively high speed signal transmission. That is, according to the present embodiment, it is possible to achieve the composite cable 1, which is small in diameter and resistant to the occurrence of deterioration in the transmission properties due to the externally applied stresses.

Summary of the Embodiment

Next, the technical ideas grasped from the above-described embodiments will be described with the aid of the reference characters and the like in the embodiments. It should be noted, however, that each of the reference characters and the like in the following descriptions is not to be construed as limiting the constituent elements in the claims to the members and the like specifically shown in the embodiments.

[1] A composite cable (1), comprising: a power supply wire (2) including a twisted wire pair aggregate (21) comprising a plurality of twisted wire pairs (211) that are laid together; a plurality of coaxial wires (3); and a plurality of signal wires (4), each of which is each smaller in outer diameter than the power supply wire (2) and the plurality of coaxial wires (3), wherein the plurality of coaxial wires (3) and the plurality of signal wires (4) are being laid helically over an outer periphery of the power supply wire (2), and each of the plurality of coaxial wires (3) is being arranged in contact with an outer periphery of the power supply wire (2), and is being arranged at substantially equally spaced intervals in a circumferential direction of the power supply wire (2), wherein each of the plurality of signal wires (4) is being arranged to separate from the power supply wire (2).

[2] The composite cable (1) according to [1] above, wherein the power supply wire (2) includes a resin tape (22), which is being wrapped around an outer periphery of the twisted wire pair aggregate (21).

[3] The composite cable (1) according to [2] above, wherein the plurality of signal wires (4) are evenly being arranged between adjacent coaxial wires (3), respectively, of the plurality of coaxial wires (3);

[4] The composite cable (1) according to any one of [1] to [3] above, further comprising: a thread-like filling member (7), which is being provided between the power supply wire (2) and the plurality of signal wires (4).

[5] The composite cable (1) according to any one of [1] to [4] above, further comprising: a binder tape (5), which is being wrapped around an outer periphery of the plurality of coaxial wires (3) and the plurality of signal wires (4), and a jacket (6), which is covering an outer periphery of the binder tape (5), wherein each of the plurality of coaxial wires (3) and each of the plurality of signal wires (4) are being arranged in contact with the binder tape (5).

[6] The composite cable (1) according to any one of [1] to [5] above, wherein the plurality of signal wires (4) include a control signal wire (41), which is being designed for control signal transmission, and a communication wire (42), Which is being designed for data communication.

[7] The composite cable (1) according to [6] above, wherein an outer diameter of the control signal wire (41) is not less than 80©% and not more than 120% of an outer diameter of the communication wire (42).

[8] The composite cable (1) according to [6] or [7] above, wherein the communication wire (42) comprises a plurality of twisted wire pairs (421) designed as communication wires, each of which comprises a twisted pair of insulated electric wires (421*c*) each having a stranded wire conductor (421*a*) and an insulating material (421*b*) made of a foamed polypropylene around a periphery of the stranded wire conductor (421*a*).

Although the embodiments of the present invention have been described above, the above described embodiments are not to be construed as limiting the inventions according to the claims. Further, it should be noted that not all the combinations of the features described in the embodiments are indispensable to the means for solving the problem of the invention. Further, the present invention can appropriately be modified and implemented without departing from the spirit thereof.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A composite cable, comprising:

a power supply wire including a twisted wire pair aggregate comprising a plurality of twisted wire pairs that are laid together;

a plurality of coaxial wires; and a plurality of signal wires, each of which is smaller in outer diameter than the power supply wire and the plurality of coaxial wires, wherein the plurality of coaxial wires and the plurality of signal wires are being laid helically over an outer periphery of the power supply wire, and each of the plurality of coaxial wires is being arranged in contact with the outer periphery of the power supply wire, and is being arranged at substantially equally spaced intervals in a circumferential direction of the power supply wire, wherein each of the plurality of signal wires is arranged to separate from the power supply wire.

2. The composite cable according to claim 1, wherein the power supply wire includes a resin tape, which is being wrapped around an outer periphery of the twisted wire pair aggregate.

3. The composite cable according to claim 2, wherein the plurality of signal wires are being arranged between adjacent coaxial wires, respectively, of the plurality of coaxial wires.

4. The composite cable according to claim 1, further comprising:

a thread-like filling member, which is being provided between the power supply wire and the plurality of signal wires.

5. The composite cable according to claim 1, further comprising:

a binder tape, which is being wrapped around an outer periphery of the plurality of coaxial wires and the plurality of signal wires; and a jacket, which is covering an outer periphery of the binder tape, wherein each of the plurality of coaxial wires and each of the plurality of signal wires are being arranged in contact with the binder tape.

6. The composite cable according to claim 1, wherein the plurality of signal wires include a control signal wire, which is being designed for control signal transmission, and a communication wire, which is being designed for data communication.

7. The composite cable according to claim 6, wherein an outer diameter of the control signal wire is not less than 80% and not more than 120% of an outer diameter of the communication wire.

8. The composite cable according to claim 6, wherein the communication wire comprises a plurality of twisted wire pairs designed as communication wires, each of which comprises a twisted pair of insulated electric wires each having a stranded wire conductor and an insulating material made of a foamed polypropylene around a periphery of the stranded wire conductor.

* * * * *